United States Patent [19]

Redman

[11] Patent Number: 4,676,526

[45] Date of Patent: Jun. 30, 1987

[54] MAILER DEVICE

[76] Inventor: Alan H. Redman, 365 Versailles Dr., Northbrook, Ill. 60062

[21] Appl. No.: 891,772

[22] Filed: Jul. 30, 1986

[51] Int. Cl.[4] ..... B42D 15/00; B42D 15/04; B41L 1/20; B65D 27/00

[52] U.S. Cl. ..... 281/5; 282/11.5 A; 283/81; 229/70

[58] Field of Search ..... 281/1, 2, 5; 282/11.5 A, 9 A, 25, 26, 27 A; 283/81; 229/68 R, 69, 70, 71, 72, 73

[56] References Cited

U.S. PATENT DOCUMENTS

| | | | |
|---|---|---|---|
| 2,155,327 | 4/1939 | Oppermann | 281/5 |
| 3,596,828 | 8/1971 | Foster et al. | 229/68 R |
| 3,820,447 | 6/1974 | Gendron et al. | 282/11.5 A |
| 4,097,067 | 6/1978 | Schechter | 229/70 |
| 4,529,229 | 7/1985 | Glibbery | 283/81 |
| 4,534,582 | 8/1985 | Howard | 283/81 |
| 4,592,572 | 6/1986 | Instance | 283/81 |

*Primary Examiner*—Paul A. Bell

*Assistant Examiner*—Paul M. Heyrana, Sr.

*Attorney, Agent, or Firm*—Hill, Van Santen, Steadman & Simpson

[57] ABSTRACT

There is disclosed herein a unique and attractive coupon mailer. The mailer includes an inner web having a pocket-forming panel and an outer web having a pocket-forming panel, a foldable panel and an adhesive tab. Adhesive is provided on the webs so that the pocket-forming panels can be adhered to each other to form a coupon-receiving pocket, and the foldable panel and adhesive tab folded over the pocket to close the mailer. The inner web also includes a plurality of advertizing-carrying panels or pages. Transverse perforations in the foldable panel are constructed to be torn to open the mailer. In another embodiment, there is provided an outer web which forms a cover for the mailer and includes a pocket-forming panel and a foldable second panel. An inner pocket-forming panel adheres to the outer web to form a coupon book-receiving pocket and fan-folded pages are saddle-stitched to the outer web to provide advertizing-carrying pages.

12 Claims, 7 Drawing Figures

MAILER DEVICE

BACKGROUND OF THE INVENTION

This invention relates to advertising mailers and, more particularly, to mailers which employ a novel printing and binding system so as to maximize the amount of advertising space and/or to mailers constructed to carry coupons.

In promoting products or services, it is sometimes desirable to advertise by direct mail. In such mailings it is usually desirable to maximize the amount of advertising space and sometimes to send coupons for goods or services.

Such mailings can be done in plain envelopes. However, it is believed that such mailings should be done in envelopes or mailers which are printed and bound to include the advertisments and/or coupons. Moreover, it is desirable that such mailers be of a unique and attractive appearance.

These mailers should be constructed so that they can be mass produced efficiently and economically. More particularly, the mailers should be constructed to readily receive and carry coupons.

In situations where it is desirable to maximize advertising space, the mailer should be constructed to maximize the number of advertising panels and be bound in a unique and attractive manner.

It is therefore an object of this invention to provide a mailer having a unique and attractive appearance and bind the mailer in a unique manner.

It is another object to provide a mailer which is of a construction that is efficiently and economically mass produced.

Yet another object of this invention is to provide a mailer constructed to readily receive and carry coupons.

A further object of this invention is to provide a mailer in which the quantity of advertising space and number of advertising panels is maximized.

These and other objects of this invention will become apparent from the following description and appended claims.

SUMMARY OF THE INVENTION

There are disclosed herein unique and attractive mailers constructed to be efficiently and economically mass produced. The mailers are constructed to receive and carry advertising coupons and/or to maximize the quantity of advertising space and panels. These mailers are constructed and bound in a unique and attractive manner.

One mailer includes an outer web and an inner web. The webs are constructed and bound in a manner, such that the outer web is foldable around the inner web so as to define the exterior or envelope for the mailer. The inner web and outer web are joined to each other so as to form a coupon-receiving pocket therebetween, which is sealed along top and bottom edges and open at both sides or ends for providing for easy coupon insertion and removal. Furthermore, the inner web may be elongated and include multiple panels, where one panel (usually an end panel) is for pocket-forming and the others can be used for advertising. Such an inner web can be accordion folded and carry numerous panels.

In another embodiment there is provided a fan-folded page assembly for binding to the inner web whereby an inner assembly is formed which carries the fan-folded page assembly. This assembly can be secured to the inner web at various points and may provide, in combination, an accordion- and fan-folded assembly which maximizes advertising space. The coupon-receiving pocket construction can also be used in this embodiment.

DESCRIPTION OF THE PREFERRED EMBODIMENT

Figure 4:
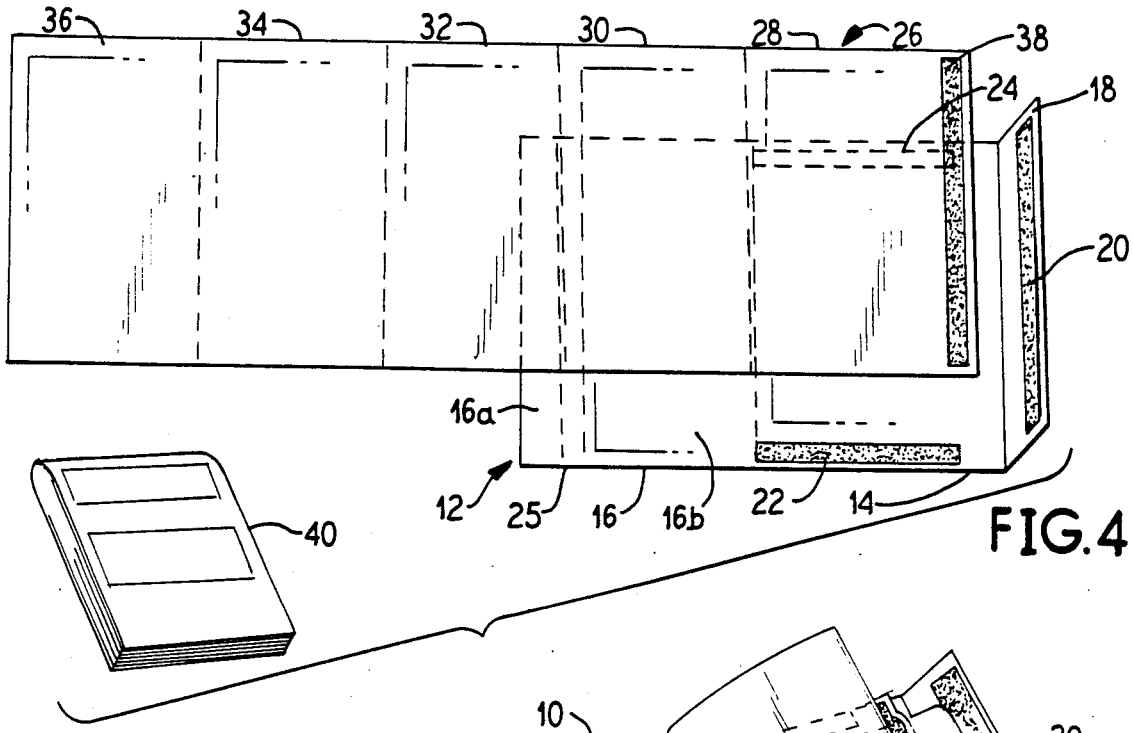
FIG. 4 is an exploded perspective view showing the inner and outer webs and coupon book.

Referring now to the drawings, one embodiment of the mailer 10 is shown in FIGS. 1–6. Turning first to FIG. 4, the mailer 10 includes an outer web 12, which forms the envelope or outer cover for the mailer and cooperates in forming a coupon-receiving pocket. The outer web 12 includes a central pocket-forming panel 14, a foldable end panel 16 to one side or at one end of the pocket-forming panel 14, and a foldable end tab 18 to the other side or at the other end of the pocket-forming panel 14. An adhesive strip 20 extends across the tab 18, and adhesive strips 22 and 24 extend along top and bottom edges of pocket-forming panel 14. The foldable end panel 16 is provided with a perforated separation strip 25, which extends across panel 16 inwardly from its free end for forming a tab section **16*a* and a body section 16*b***.

In this embodiment, the mailer also includes an elongated multi-panel accordion folding inner web-like member 26, which has a pocket-forming panel section 28 at one end and a plurality of smaller accordion foldable advertising panel sections 30, 32, 34 and 36 extending therefrom. An adhesive strip 38 is provided on the pocket-forming panel 28 at the end of the inner member 26. The pocket-forming panel 28 is larger than the foldable panels 30, 32, 34 and 36 so that when the smaller panels are folded, the adhesive strip 38 remains exposed and is not covered by the foldable panels.

A coupon book 40 is provided to be carried in the pocket formed between the pocket-forming panels 14 and 28.

Figure 5:
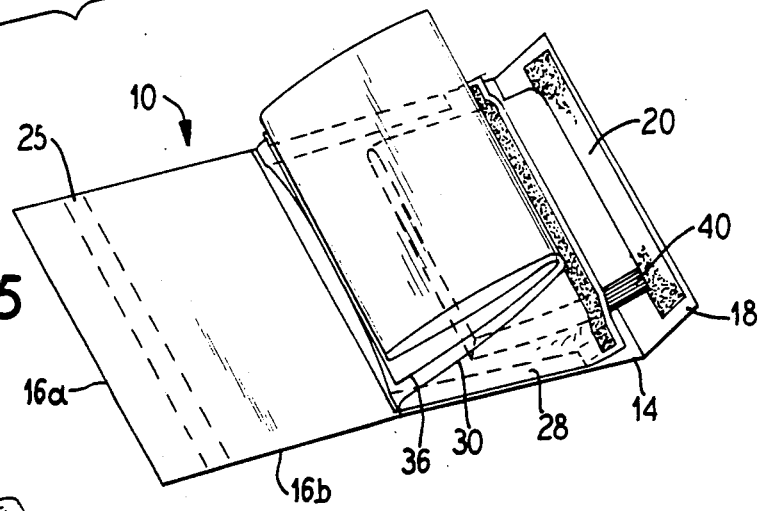
FIG. 5 is a perspective view showing the folding of the inner web and insertion of the coupon book into one side or end of the coupon book pocket and arranged for closing.

The mailer is assembled by adhering the underside, that is the non-adhesive side, of the pocket-forming panel 28 of the inner web to the side adhesive strips 22 and 25 on the outer pocket-forming panel 14. This forms a coupon-receiving pocket, which is closed at the top and bottom and open at both sides or ends, that is, open adjacent the tab 18 and open adjacent the foldable end panel 16 as seen in FIG. 5. The coupon book can then be inserted into the pocket through the open end adjacent tab 18 as shown in FIG. 5.

The foldable panels 30, 32, 34 and 36 are then gathered in an accordion-fold manner, or as shown in FIG. 5. The mailer can then be closed by first folding the end panel 16 over the folded internal web and adhering the panel 16 to the lateral adhesive strip 38 on the inner pocket-forming panel. Next, the tab 18 is folded over the panel 16 and the transverse adhesive strip 20 on the folded tab 18 is adhered to the back of panel 16 to close the mailer.

Figure 1:
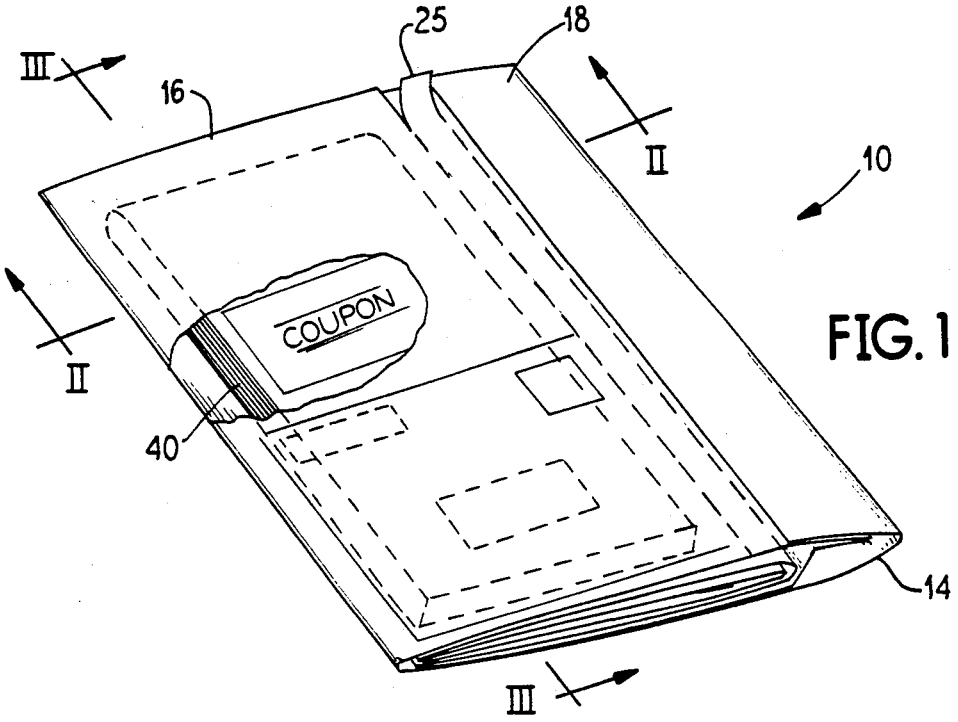
FIG. 1 is a perspective view of a closed mailer.
Figure 2:
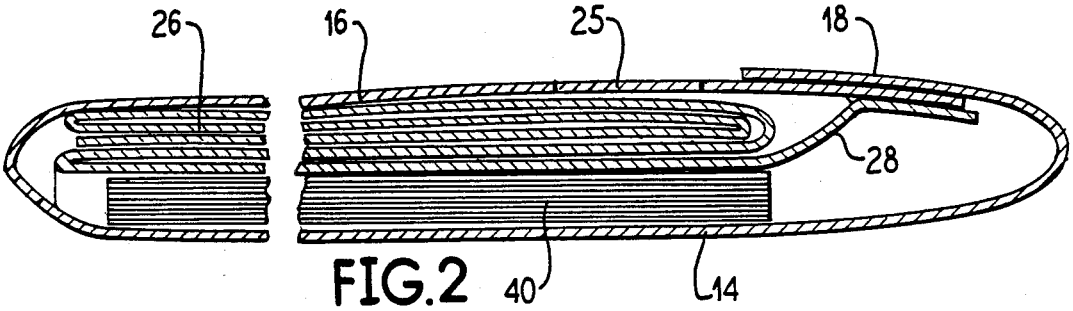
FIG. 2 is a transverse sectional view, taken along line II—II of FIG. 1, showing the folded panel sections and the coupon book in place.
Figure 3:
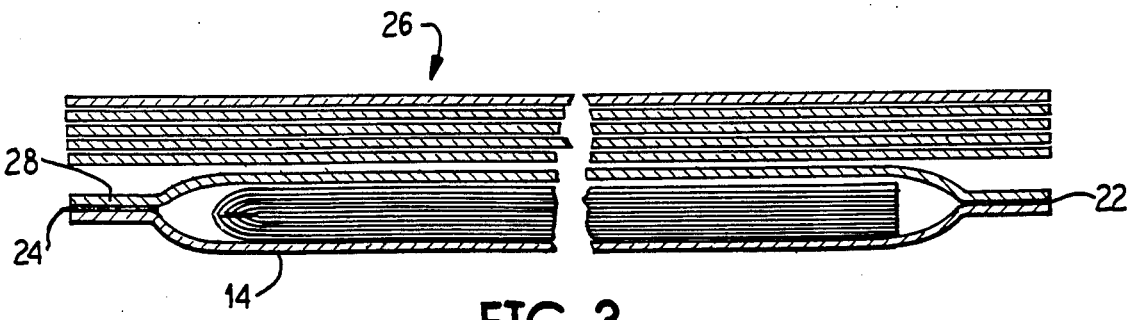
FIG. 3 is a fragmentary longitudinal sectional view, taken along line III—III of FIG. 1, also showing the folded panel sections and coupon book.

A completely closed mailer is shown in FIG. 1

Figure 6:
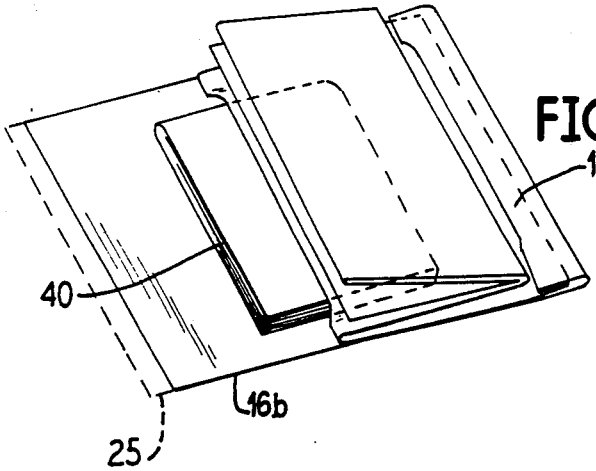
FIG. 6 is a perspective view showing the mailer opened with the coupon book being removed from the other side or end of the pocket.

The mailer is opened by tearing the perforation strip 24 so as to separate the tab end 16*a*, which is now bounded to tab 18, from the body 16*b* of the panel 16. This separation permits the mailer to be opened by folding back the body 16*b* of panel 16 as shown in FIG. 6.

The coupon book 40 is then removed from the open end of the pocket adjacent the opened panel 16. The other end of the pocket, through which the book was inserted into the pocket, remains closed as the adhesive strips 20 and 38 are still bound to the separated tab portion 16*a* of the foldable panel 16.

Appropriate advertising indicia is provided on all of the viewable panel sections of the inner web 26, which can be unfolded. By this construction the inner and outer webs can easily be fabricated by printing and similar operations. The webs are then readily assembled and insertion of the coupon book is easily done.

Figure 7:
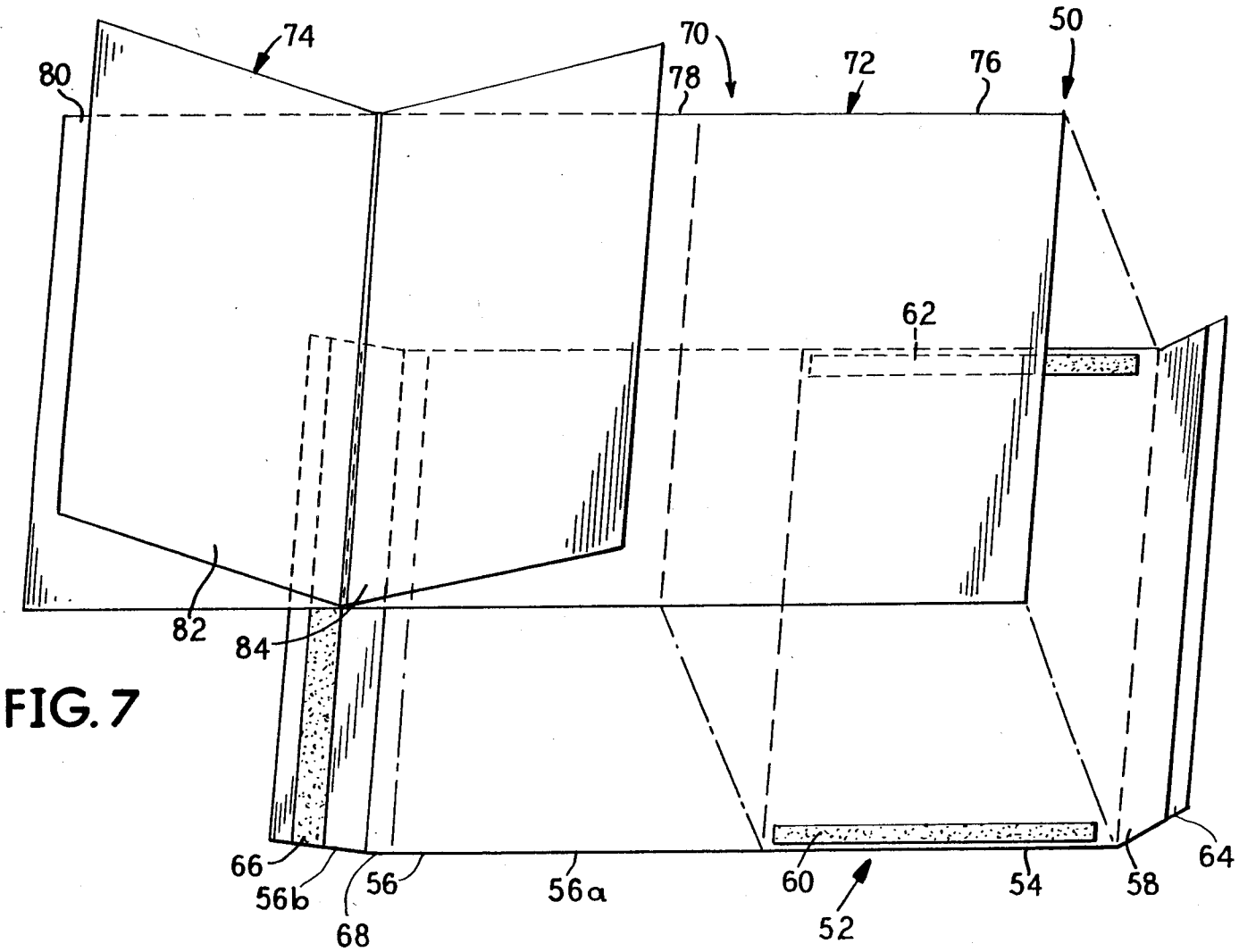
FIG. 7 is an exploded perspective view showing the outer web, inner web and fan-folded page assembly of another embodiment of the mailer.

Another embodiment 50 of the mailer is shown in FIG. 7. In that embodiment there is provided an outer web or cover 52 having a pocket-forming central panel 54, a foldable end panel 56, and an end or seal 58. Pocket-forming adhesive strips 60 and 62 are provided along the side edges of the pocket-forming panel 54. A transverse seal strip 64 is provided along the seal tab 58. A glue bead 66 is provided on the outer end of foldable panel 56. A perforated tear strip 68 is provided in the outer panel adjacent the glue bead 66 and between the bead and the center panel 54, for use in opening a sealed mailer.

The inner assembly 70 includes an inner web 72 and fan-folded page assembly 74. The inner web includes a pocket-forming end panel 76 and two foldable panels 78 and 80. The two panels 78 and 80 are narrower than the pocket-forming end panel 76, so that when folded, the two panels overlie the pocket-forming end panel, but leave exposed a small marginal edge, in this view along the right-hand edge.

The fan-folded page assembly is shown as including two folded pages or panels 82 and 84 and is bound by gluing to the fold between the second and third panels 78 and 80. The width of these fan-folded pages 82 and 84 is substantially the same as the width of the second and third inner panels 78 and 80 and less than the width of the pocket-forming end panel 76.

It will be appreciated that the fan-folded page assembly can include more than two pages, such as 4, 8, or 16, in accordance with normal printing practice.

Furthermore, the inner assembly can be fabricated in a number of ways. For example, the inner web can include multiple panels, for example, 4, 5, or more. Next, the fan-folded pages can have multiple pages, 2, 4, 8, 16, etc. Finally, the fan-folded pages can be secured to the inner web at different positions, for example, at an end fold (i.e., between the last two panels) or at an intermediate fold (i.e., a fold between the end folds).

In order to assemble this mailer, the pocket-forming end panel 76 of the inner web 72 is adhered to the top and bottom adhesive strips 62 and 64 on the pocket-forming central panel 54 of the outer web 52. Then the remaining panels 78 and 80 of the inner web and the fan-folded pages are folded down onto the pocket-forming panel 72.

Next, the outer web end panel 56 is folded over the folded inner web and glue bead 66 on the panel 56 is secured to the exposed side edge of pocket-forming panel 76, so as to close the folded pages. Then the outer tab 58 is folded over onto the closed outer web end panel 80 and adhered thereto with the adhesive layer or glue strip 64.

This completely closes the mailer.

It is to be noted that if desired, a coupon book can be inserted into the pocket formed between panels 54 and 76 as previously described with reference to the embodiment of FIGS. 1–6 before closing the mailer. However, in some situations, no book is to be used, no pocket is formed or the pocket is left empty.

In order to open the mailer, the perforated "zip-lock-type" strip is opened, which separates the end panel 56 into a body section 56*a* and tab section 56*b*. Upon separation, the tab section 56*b* remains secured to the pocket-forming panel 76 and outer tab 58. The body section 56*a* can be folded open and the inner assembly of advertising panels opened to display the ads. If a coupon book has been used, it can also be removed after the outer envelope has been opened.

It will be appreciated that numerous changes and modifications can be made to the embodiments disclosed herein without departing from the spirit and scope of this invention.

I claim as my invention:

1. A coupon mailer comprising:

an outer web-like cover-forming member having a pocket-forming central panel section, an end panel section foldably secured along one side edge of pocket-forming section, a tab section foldably secured at the other side edge of the pocket-forming panel section, and adhesive means along the top and bottom of said pocket-forming panel section and on said tab section;

an inner web-like member having a plurality of foldable panel sections, one of which is a pocket-forming panel section;

said inner pocket-forming panel section constructed to overlie said outer pocket-forming panel section for adhesive binding to said outer section so as to form a coupon-receiving, pocket-like space between the inner panel section and said outer panel section;

said foldable inner web panel sections constructed to foldably overlie said inner pocket-forming panel;

said foldable outer web end panel section being foldable so as to overlie the outer pocket-forming panel sections and inner foldable panel sections and adhesively bound to said adhesive means on said inner pocket-forming panel section; and said tab means being foldable over said foldable outer panel section and adhesively bound to the other side of said foldable outer panel section so as to sealingly close said outer web around said inner web.

2. A mailer as in claim 1, wherein said outer web end panel section includes perforation means adjacent the free end thereof, which defines a separable tab section and a body section for said end panel section, said body section and separable tab section adapted to be separated along said perforation for opening said mailer so as to expose said internal web and permit retrieval of a coupon book from the pocket defined by the inner and outer pocket-forming panel section.

3. A mailer as in claim 2, wherein said inner member further includes a plurality of foldable panel sections, each of which are narrower than said inner web pocket-forming section so that said adhesive means is positioned to adhesively bound to said outer second panel.

4. A mailer as in claim 3, wherein said inner member includes five panel sections with said pocket-forming section being an end section thereof.

5. A mailer as in claim 3, wherein said inner foldable sections are adapted to overlie said folded inner end panel section.

6. A mailer as in claim 1, wherein said coupon book pocket is open at both ends so as to permit insertion of a coupon book through the end adjacent said tab and for removal from an opened mailer through the end adjacent said foldable outer section.

7. A mailer as in claim 1, wherein said coupon book pocket is open at least at the end adjacent said adhesive tab.

8. A mailer as in claim 1, further including a plurality of coupons received in said coupon-receiving pocket.

9. A mailer as in claim 1, wherein said mailer further includes a fan-folded page assembly bound to said inner web at a fold line between panel sections.

10. A mailer as in claim 9, wherein said inner web includes at least two end panels joined to said pocket-forming end panel section and said fan-folded page assembly is bound to said inner web along the fold line between said end sections.

11. A mailer comprising:

an outer web-like cover-forming member having a central panel section, an end panel section foldably secured along one side edge of said central section, a tab section foldably secured at the other side edge of the central panel section, and adhesive means on said central panel section and on said tab section;

an inner web-like member having a plurality of foldable panel sections, one of which is an end panel section for securement to said central section;

said inner end panel section constructed to overlie said outer central panel section for adhesive bounding to said outer section;

said mailer further includes a fan-folded page assembly bound to said inner web at a fold line between panel sections;

said foldable inner web panel sections constructed to foldably overlie said end panel section;

said foldable outer web end panel section being foldable so as to overlie the inner web sections and adhesively bound to said adhesive means on said inner central panel section; and said tab means being foldable over said foldable outer panel section and adhesively bound to the other side of said foldable outer panel section so as to sealingly close said outer web around said inner web.

12. A mailer as in claim 10, wherein said inner web includes at least two end panels joined to said pocket-forming end panel section and said fan-folded page assembly is bound to said inner web along the fold line between said end section.

* * * * *